US008408750B2

(12) United States Patent
Chang et al.

(10) Patent No.: US 8,408,750 B2
(45) Date of Patent: Apr. 2, 2013

(54) LED ILLUMINATING DEVICE

(75) Inventors: Shao-Han Chang, New Taipei (TW); Fu-Qiu Shi, Shenzhen (CN); Qing-Shan Cao, Shenzhen (CN)

(73) Assignees: Hong Fu Jin Precision Industry (ShenZhen) Co., Ltd., Shenzhen (CN); Hon Hai Precision Industry Co., Ltd., New Taipei (TW)

( * ) Notice: Subject to any disclaimer, the term of this patent is extended or adjusted under 35 U.S.C. 154(b) by 10 days.

(21) Appl. No.: 13/191,476

(22) Filed: Jul. 27, 2011

(65) Prior Publication Data

US 2012/0161628 A1 Jun. 28, 2012

(30) Foreign Application Priority Data

Dec. 28, 2010 (CN) ..... 2010 1 0609080

(51) Int. Cl.
*F21V 29/00* (2006.01)

(52) U.S. Cl. ..... 362/294; 362/373

(58) Field of Classification Search ..... 362/294, 362/373, 249.02, 800
See application file for complete search history.

(56) References Cited

U.S. PATENT DOCUMENTS

| | | | | |
|---|---|---|---|---|
| 7,874,710 | B2 * | 1/2011 | Tsai et al. | 362/373 |
| 8,057,075 | B2 * | 11/2011 | Horng et al. | 362/373 |
| 8,115,395 | B2 * | 2/2012 | Horng et al. | 314/117 |
| 8,246,202 | B2 * | 8/2012 | Mart et al. | 362/249.02 |
| 2005/0174780 | A1 * | 8/2005 | Park | 362/294 |

FOREIGN PATENT DOCUMENTS

| | | | |
|---|---|---|---|
| CN | 101118052 | A | 2/2008 |
| CN | 101865395 | A | 10/2010 |
| CN | 101881387 | A | 11/2010 |

* cited by examiner

*Primary Examiner* — Thomas Sember
(74) *Attorney, Agent, or Firm* — Altis Law Group, Inc.

(57) ABSTRACT

An LED illuminating device includes a hollow base including a first end and a second end, an LED substrate, a connector, and a driving circuit module accommodated in the base. A plurality of vents are defined in a circumferential wall of the hollow base; a space is formed between a circumferential wall of the driving circuit module and the inner surface of the circumferential wall of the hollow base. The space can communicate with the plurality of vents and serve as a hot air channel, to promote heat exchange between hot air in the base and cool air outside the base.

10 Claims, 5 Drawing Sheets

LED ILLUMINATING DEVICE

BACKGROUND

1. Technical Field

The present disclosure relates to light emitting diode (LED) illuminating devices and, particularly, to an LED illuminating device with heat dissipation module.

2. Description of Related Art

Compared to traditional light sources, LEDs have advantages, such as high luminous efficiency, low power consumption, and long service life. To dissipate heat from LED lamps, a type of heat sink called "sunflower heat sink" is often used in LED lamps having a plurality of LEDs. The sunflower heat sink has a post-shaped conductive member and a plurality of fins extending outward and radially from a circumferential surface of the conductive member. One problem with this type of LED illuminating device is its large size and heavy weight. In addition, dust tends to cumulate in the spaces between the fins, which affects heat dissipation.

Therefore, there is room for improvement in the art.

BRIEF DESCRIPTION OF THE DRAWINGS

Many aspects of the embodiments can be better understood with reference to the following drawings. The components in the drawings are not necessarily drawn to scale, the emphasis instead being placed upon clearly illustrating the principles of the present disclosure. Moreover, in the drawings, like reference numerals designate corresponding parts throughout the several views, and all the views are schematic.

DETAILED DESCRIPTION

Embodiments of the present disclosure are now described in detail, with reference to the accompanying drawings.

Figure 1:
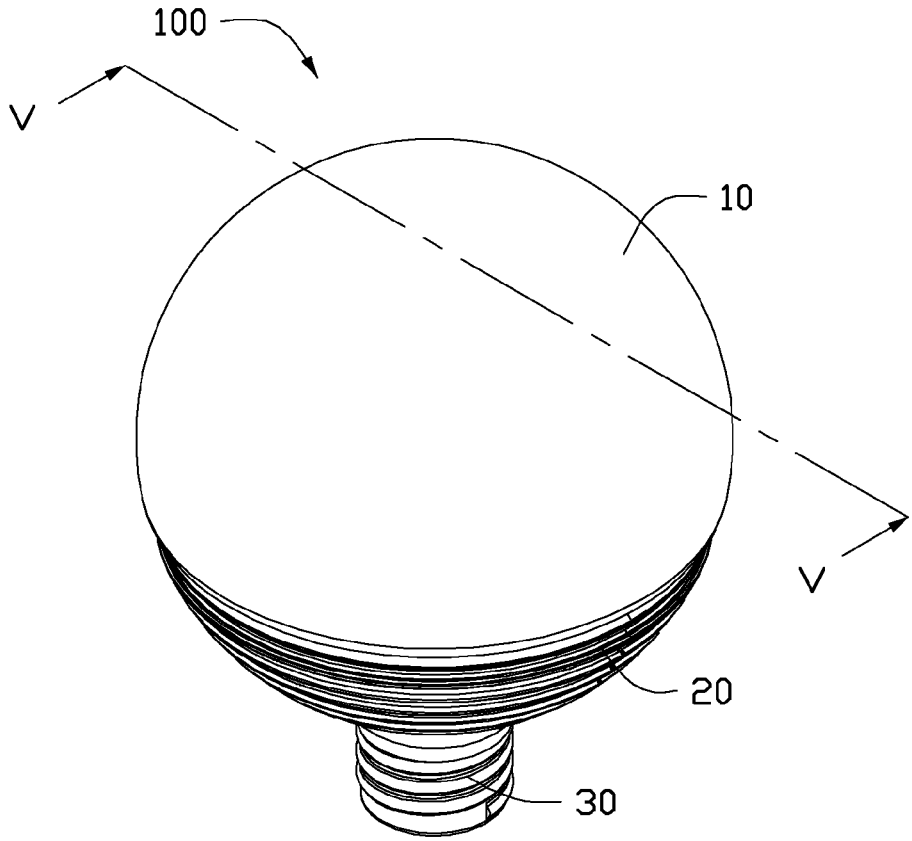
FIG. 1 is an isometric view of an LED illuminating device in accordance with an exemplary embodiment.

Referring to FIG. 1, an embodiment of an LED illuminating device 100 is illustrated. The device 100 includes a bulb 10, a base 20, and a connector 30. The bulb 10 and the connector 30 are respectively attached to two opposite ends of the base 20. The connector 30 is used to connect to a coupling connector to electrically connect the device 100 to a power source.

Figure 2:
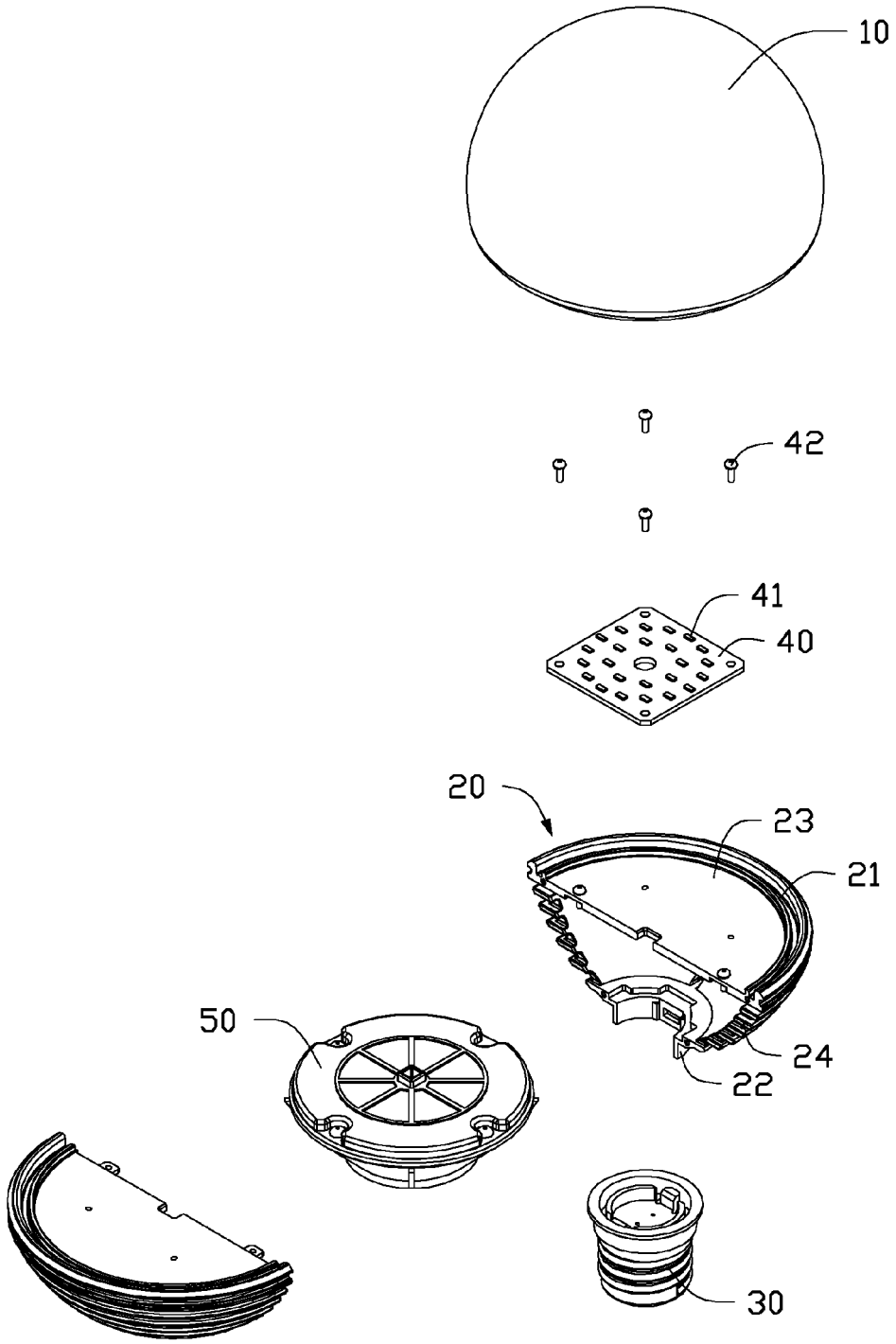
FIG. 2 is an isometric, exploded view of the LED illuminating device of FIG. 1.

Referring to FIG. 2, the device 100 further includes an LED substrate 40, and a driving circuit module 50. A number of LEDs 41 are arranged on the LED substrate 40. The driving circuit module 50 is electrically connected to the connector 30 and the LED substrate 40.

The base 20 is shaped like a hollow cone and consists of two half cone-like hollow housings joined together. The base 20 includes a first end 21 and a second end 22 whose diameter is smaller than the diameter of the first end 21. A recess 23 is defined in the top surface of the first end 21 for receiving the LED substrate 40. The LED substrate 40 is fixed in the recess 23 with screws 42. The base 20 is made of metal with good heat conductivity, such as copper or aluminum. In another embodiment, the base plate 20 can be made of ceramic. A heat-conductive medium (not shown) is arranged between the LED substrate 40 and the top surface of the first end 21, for transferring the heat generated by the LEDs 41 from the LED substrate 40 to the base 20. In the embodiment, the heat-conductive medium can be a graphite sheet, heat-conductive glue or heat-conductive ceramic. The connector 30 is connected with the second end 22.

The bulb 10 is fixed on the first end 21 of the base 20. The light beams emitting from the LEDs 41 pass through the bulb 10 and spread out. The bulb 10 can be made of transparent or translucent material mixed with light diffusion particles to improve the light scattering effect of the light. In another embodiment, a scatter layer or a film of scatter material can be arranged on the surface of the bulb 10 to scatter the light beams emitting from the LEDs 41, thus achieving a homogeneous illuminating effect.

Figure 3:
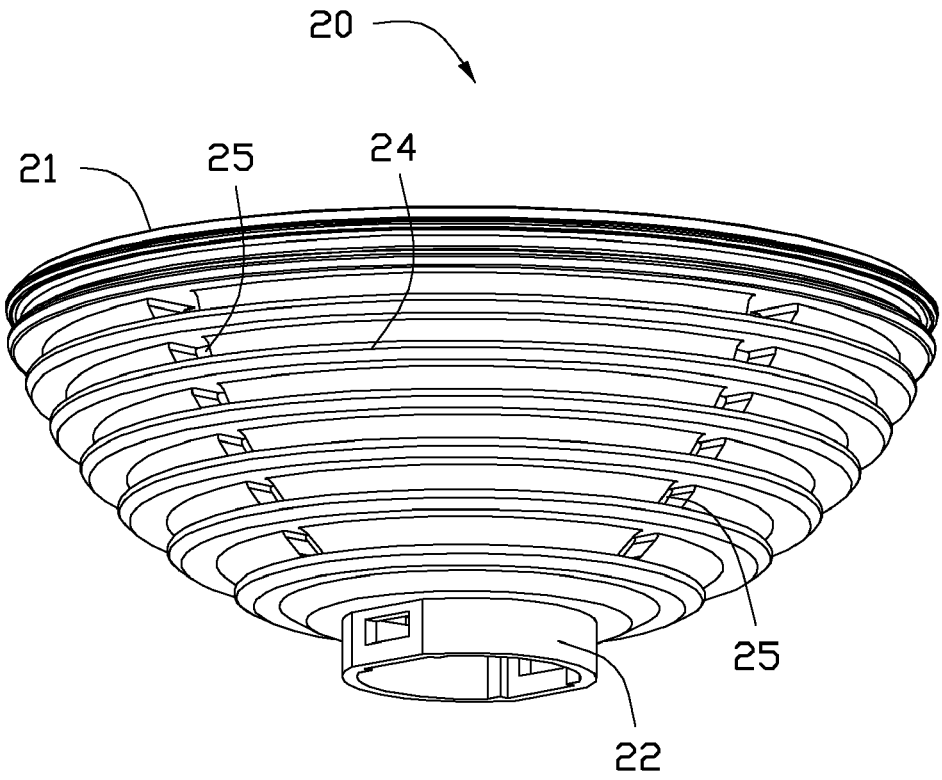
FIG. 3 is a schematic view of a base of the LED illuminating device of FIG. 1.

Referring to FIGS. 2 and 3, the base 20 further includes a number of cooling fins 24 arranged on a circumferential wall of the base 20 to increase the heat dissipation area. A number of vents 25 are defined in the circumferential wall of the base 20. In this embodiment, at least one row of the vents 25 are arranged from the first end 21 to the second end 22. Each row of vents 25 includes at least two vents 25, for example, three to ten vents 25. The cooling fins 24 are horizontally extended and parallel to the LED substrate 40 mounted on the top surface of the first end 21 of the base 20.

Figure 4:
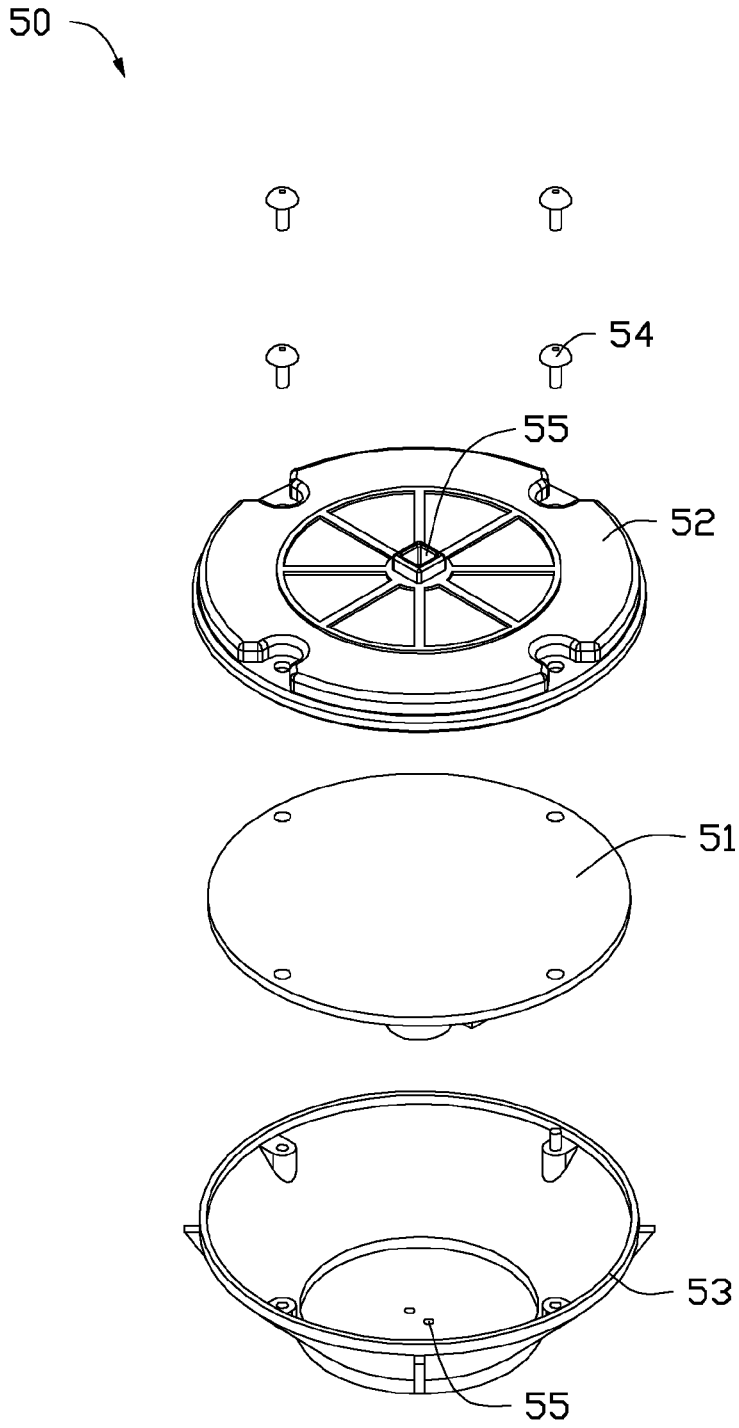
FIG. 4 is a schematic view of a driving circuit module of the LED illuminating device of FIG. 1.

Referring to FIGS. 2 and 4, the driving circuit module 50 is accommodated in the base 20. The driving circuit module 50 includes a driving circuit board 51, an upper cover 52 and a bottom cover 53. The upper cover 52 is fixed on the bottom cover 53 for shielding the driving circuit board 51 in the space (not labeled) defined between the upper cover 52 and the bottom cover 53. Both the upper cover 52 and the bottom cover 53 include through holes 55 allowing the wires (not shown) to pass through to connect the driving circuit board 51 with the connector 30 and the LED substrate 40.

Figure 5:
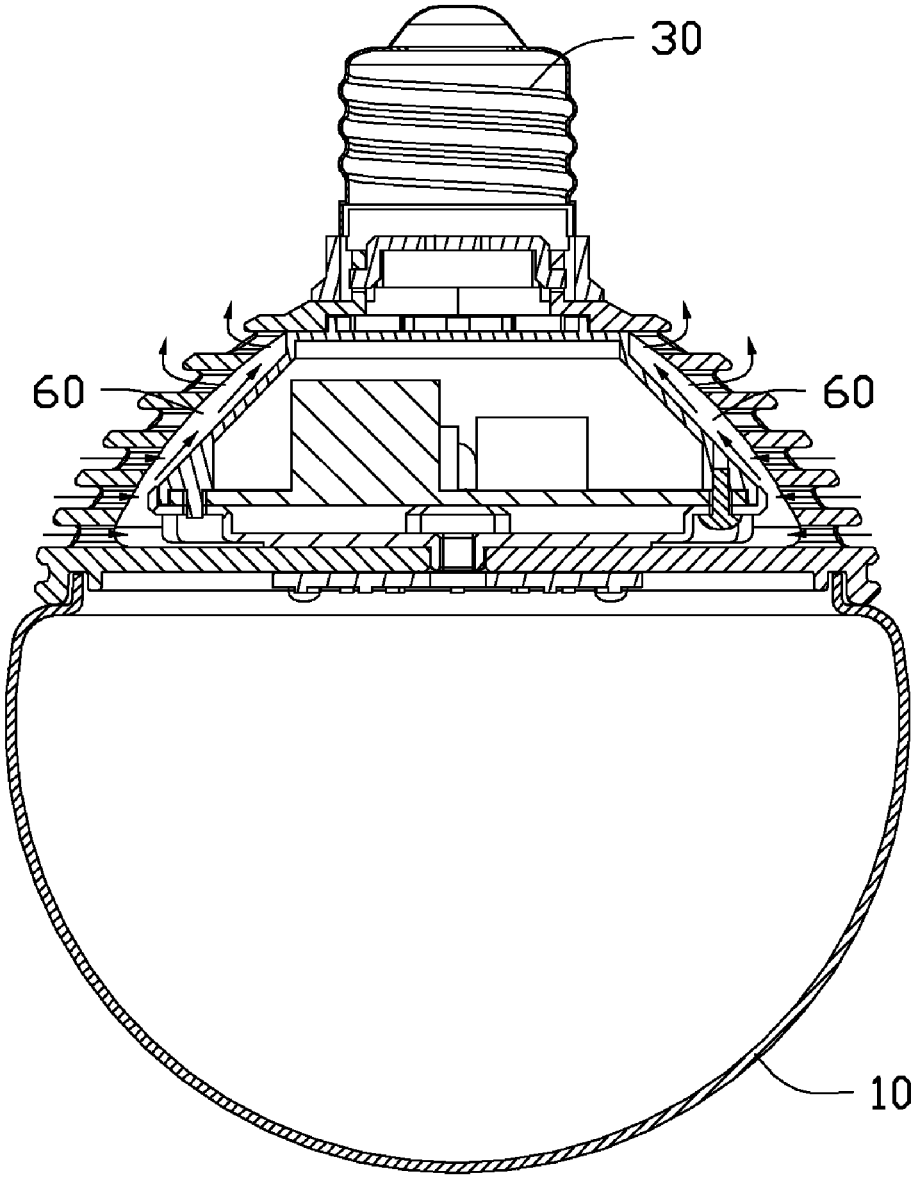
FIG. 5 is a cross-sectional view, in an inverted manner, of the LED illuminating device of FIG. 1, taken along line V-V thereof, with arrows showing a heat dissipation pattern of the LED illuminating device of FIG. 1.

Referring to FIG. 5, the heat generated by the LED substrate 50 is transferred to the base 20 and the cooling fins 24 via the heat-conductive medium, and finally transferred outside of the base 20. The space 60 defined between the circumferential wall of the driving circuit module 50 and the inner surface of the circumferential wall the base 20 serve as a hot air channel, to promote heat exchange between hot air in the base 20 and cool air outside the base 20. The hot air exits the LED illuminating device 100 from the vents 25 adjacent to the second end 22. The cool air enters the space 60 from the vents 25 adjacent to the first end 21. The cool air cools the LED illuminating device 100 by heat exchanging with the driving circuit module 50 and the inner surface of the circumferential wall of the base 20, thus promoting the cooling efficiency.

It is to be understood, however, that even though numerous characteristics and advantages of the present disclosure have been set forth in the foregoing description, together with details of the structure and function of the present disclosure, the present disclosure is illustrative only, and changes may be made in detail, especially in matters of shape, size, and arrangement of parts within the principles of the present disclosure to the full extent indicated by the broad general meaning of the terms in which the appended claims are expressed.

What is claimed is:

1. An LED illuminating device, comprising:

a hollow base comprising a first end and a second end opposite to the first end, the hollow base comprising a circumferential wall, and a plurality of rows of vents defined in the circumferential wall of the hollow base, each of the rows of the vents being arranged along a direction from the first end to the second end, each of the rows of the vents including an intake vent adjacent to the first end and an outlet vent adjacent to the second end;

an LED substrate mounted on the first end of the hollow base and comprising a plurality of LEDs;

a driving circuit module accommodated in the hollow base and electrically connecting with the LEDs; and a space formed between a circumferential wall of the driving circuit module and an inner surface of the circumferential wall of the hollow base, the space being communicated with the vents;

wherein the intake vents are configured for introducing cold air to the space and the outlet vents are configured for allowing hot air in the space to exit therethrough.

2. The LED illuminating device according to claim 1, wherein each of the rows of the vents comprises three to ten vents.

3. The LED illuminating device according to claim 1, wherein the base is made of metal or ceramic.

4. The LED illuminating device according to claim 1, wherein a recess is formed in the top surface of the first end for receiving the LED substrate.

5. The LED illumination device according to claim 4, wherein the first end has a diameter larger than a diameter of the second end.

6. The LED illuminating device according to claim 1, wherein a plurality of cooling fins are arranged on the circumferential wall of the base to increase the heat dissipation area.

7. The LED illumination device according to claim 6, wherein the cooling fins are parallel to the LED substrate.

8. The LED illuminating device according to claim 1, the LED illuminating device further comprises a bulb connected to the first end of the hollow base, and light beams emitting from the plurality of LEDs pass through the bulb and spread out.

9. The LED illuminating device according to claim 8, wherein the bulb is made of transparent or translucent material mixed with light diffusion particles.

10. The LED illuminating device according to claim 1, wherein the driving circuit module comprises a driving circuit board, an upper cover and a bottom cover, the upper cover is fixed on the bottom cover for shielding the driving circuit board in a space defined between the upper cover and the bottom cover.

* * * * *